US009681693B1

(12) United States Patent
Biesecker, Sr. et al.

(10) Patent No.: US 9,681,693 B1
(45) Date of Patent: Jun. 20, 2017

(54) HAIR REPLACEMENT SYSTEM AND METHOD

(71) Applicant: Hair Direct, Inc., Lancaster, PA (US)

(72) Inventors: William Biesecker, Sr., Bainbridge, PA (US); Megan Jones, Lancaster, PA (US)

( * ) Notice: Subject to any disclaimer, the term of this patent is extended or adjusted under 35 U.S.C. 154(b) by 0 days.

(21) Appl. No.: 14/596,594

(22) Filed: Jan. 14, 2015

(51) Int. Cl.
*A41G 5/00* (2006.01)

(52) U.S. Cl.
CPC ..... *A41G 5/0046* (2013.01); *A41G 5/008* (2013.01)

(58) Field of Classification Search
CPC ..... A41G 5/00; A41G 5/0006; A41G 5/004; A41G 5/0033; A41G 5/008; A41G 3/00; A41G 3/0025; A41G 3/0075; A41G 3/0066; A41G 3/0041
See application file for complete search history.

(56) References Cited

U.S. PATENT DOCUMENTS 3,139,093 A * 6/1964 Frishman ..... A41D 5/003 132/53
3,756,879 A * 9/1973 Bonham ..... A41G 3/0075 132/201
4,422,230 A * 12/1983 Nemoto ..... A41G 3/0075 132/200
4,453,555 A * 6/1984 Finamore ..... A41G 3/00 132/201
4,456,019 A * 6/1984 Finamore ..... A41G 3/00 132/201

* cited by examiner

*Primary Examiner* — Todd E Manahan
*Assistant Examiner* — Brianne Kalach
(74) *Attorney, Agent, or Firm* — Riddle Patent Law, LLC; Charles L. Riddle, Esq.

(57) ABSTRACT

A hair system includes a thin skin hair unit having adhesive pre-applied to the inside surface, a sheet of silicone is located on a dome shaped form, and the hair unit is located on the form and silicone layer for storage, shipping to the client, and removal and use by the client.

7 Claims, 3 Drawing Sheets

HAIR REPLACEMENT SYSTEM AND METHOD

CROSS REFERENCE TO RELATED APPLICATIONS

Not Applicable

STATEMENT AS TO FEDERALLY SPONSORED RESEARCH

Not applicable.

BACKGROUND OF INVENTION a. Field of Invention

The invention relates generally to the field of hair replacement systems. More particularly, the invention refers to a hair replacement system and method for making and using a hair replacement system.

b. State of the Art

A hairpiece or toupee is a piece of natural or synthetic hair worn to cover partial baldness. Various configurations are known in the art. A typical hairpiece comprises a base material or a "base" which is attached to the scalp on one side, and, on the other side of the base, hair is attached thereto. Attachment is accomplished with an adhesive or adhesive tape. Bases are made of lace or sheer lace, and more recently a "thin skin" type base is used in the industry for a more natural look and feel.

A custom hairpiece is one that is fitted to match the balding area of a client's head and blend with the client's natural hair. The process begins with obtaining the size and shape of the area of the scalp that is desired to be covered with the hairpiece to obtain the dimensioning of the base. Other specifications such as hair color and style are also solicited from the client. The base dimensioning and other specifications are used to fabricate a hairpiece. The hairpiece is typically then shipped to the client or the client's stylist/technician. At this point the stylist/technician, with the client present to wear the hairpiece, cuts and styles the hairpiece to blend it with the client's natural hair.

Attachment of the hairpiece is accomplished with liquid adhesive, adhesive tape, or a combination thereof. If liquid adhesive is utilized, it is applied to the scalp and the base of the hairpiece by dabbing, brushing, or squeeze on and then allowed to partially dry to ensure a strong durable bond.

Inherent in the handling, customization, and attachment of the hairpiece is the hair from the hairpiece becoming stuck to the adhesive side of the base, with or without adhesive applied to it. The nature of the hairpiece base and hair being flimsy and delicate results in great difficulty in handling the hairpiece. Once adhesive is applied to the base, the chances of hair from one side of the base being stuck to the other significantly increase. It is therefore desirable to have a hair system and method that mitigates the difficulty in handling a hairpiece.

Many hair system clients or would be clients are dissuaded from wearing artificial hair because they do not wish to visit stylists/technicians to have the stylist/technician prepare the client's scalp and attach the hairpiece. Often, an experienced stylists/technician is difficult to locate. If stylists/technicians are available, the costs of a technician visit are often prohibitive. With self-application of the hairpiece, the client performs the preparation of the scalp and the adhesion/attachment steps that the stylist/technician would perform. The difficulties faced by the stylist/technician discussed above become further compounded when a client performs these steps. It is therefore desirable, and an object of the invention, to have a hair system and method that mitigates the difficulty in handling a hairpiece and further enables self-application.

SUMMARY OF INVENTION

The instant invention is directed to a custom fitted hair system that facilitates self application by the client. A hair system includes a thin skin hair unit having adhesive pre-applied to the inside surface, a sheet or layer of silicone is located on a dome shaped form, and the hair unit is located on the form and silicone layer for storage, shipping to the client, and later use and application by the client and/or stylist.

In a preferred embodiment a method of making a hair replacement system is disclosed. A hair unit is provided. One or more layers of adhesive are applied to the inside surface of the hair unit and allowed to dry partly to tack. A dome shaped form is provided. The form has an adhesive resistant outer layer of material upon which the hair unit is placed, such that the partly dried adhesive contacts the adhesive resistant outer layer. The hair unit, with the adhesive applied thereto, is then placed onto a dome shaped form.

In a preferred embodiment of the present invention method, the step of "providing a dome shaped form" includes pouring a liquid containing silicone onto the form. The resulting silicone layer enables peeling of the hair unit from the dome shaped form.

In an embodiment of the present invention method, the step of "providing a dome shaped form" includes providing a material that is resistant to sticking by the adhesive applied to the inside surface of the hair unit, and locating the material over the dome shaped form.

A method of making and using a hair replacement system is disclosed. At a specification location, a client's custom specifications are obtained. Said specifications relate to a size and shape of the area of the scalp that is desired to be covered with a hairpiece, hair color, and hair style. At a fabrication location, a hair unit is fabricated using one or more of the specifications obtained from the client. The hair unit includes a thin base sheet portion having an inside surface and an outside surface connected at a periphery, and a plurality of hair extending outwardly from the outside surface. Also provided, for use in the method, is a dome shaped form having an outer layer of material that is resistant to sticking by the adhesive applied to the inside surface of the hair unit. One or more layers of adhesive are applied to the inside surface of the hair unit. The adhesive is allowed to dry to tack. The hair unit is then placed onto the dome shaped form. The stick resistant layer is located between the inside surface of the hair unit and the dome shaped form. The hair unit, located on the dome shaped form, with the non stick layer located between, is shipped to a client location. At the client location, the hair unit is removed from the dome shaped form and the layer of material that is resistant to sticking, and a temporary adhesive reactivation solution is sprayed onto the inside surface of the hair unit and/or the scalp of the client. While the temporary adhesive reactivation solution remains effective to inhibit adhesion, the inside surface of the hair unit is placed onto the scalp of the client, and the inside surface of the hair unit is slid about the scalp to desirably locate the hair unit on the scalp of the client.

In a preferred embodiment of the present invention method, the step of "providing a dome shaped form" includes pouring a liquid containing silicone onto the form.

In an embodiment of the preset method, the step of "providing a dome shaped form" includes providing a material that is resistant to sticking by the adhesive applied to the inside surface of the hair unit, and locating the material over the dome shaped form.

In an embodiment of the preset method, the step of "providing a dome shaped form" includes providing a dome shaped form that has a silicone outer surface layer added on to or formed into the dome shaped form.

In an embodiment of the preset method, the steps of "applying one or more layers of adhesive" and "placing the hair unit onto a dome shaped form" are performed at the fabrication location.

A method of application of a hair replacement system is disclosed. A user is provided a hair system. The hair system comprises a hair unit that includes a thin base sheet portion having an inside surface and an outside surface connected at a periphery, a plurality of hair extending outwardly from the outside surface, and one or more layers of liquid adhesive applied to the inside surface and allowed to dry to tack. The hair unit is located on a dome shaped form having a generally convex surface and a generally concave surface. The form has a layer of silicone or other adhesion resistant material located between the dome shaped form and the inside surface of the hair unit. The silicone or adhesion resistant material has a first side in contact with (or forming part of) the convex surface of the dome shaped form, and also having a second side in contact with the inside surface of the hair unit. The hair unit is removed from the dome shaped form, and a temporary adhesive reactivation solution is sprayed onto the inside surface of the hair unit and/or the scalp of the client. The inside surface of the hair unit is placed onto the scalp of the client, and is slidably moved about the scalp to desirably locate the hair unit on the scalp, while the temporary adhesive reactivation solution remains effective to inhibit adhesion.

Additional features, advantages, and embodiments of the invention may be set forth or apparent from consideration of the following detailed description. Moreover, it is to be understood that both the foregoing summary of the invention and the following detailed description are exemplary and intended to provide further explanation without limiting the scope of the invention.

BRIEF DESCRIPTION OF THE DRAWINGS

The accompanying drawings, which are included to provide a further understanding of the invention and are incorporated in and constitute a part of this specification, illustrate preferred embodiments of the invention, and, together with the detailed description serve to explain the principles of the invention. In the drawings.

DETAILED DESCRIPTION OF THE EMBODIMENTS

Figure 1:
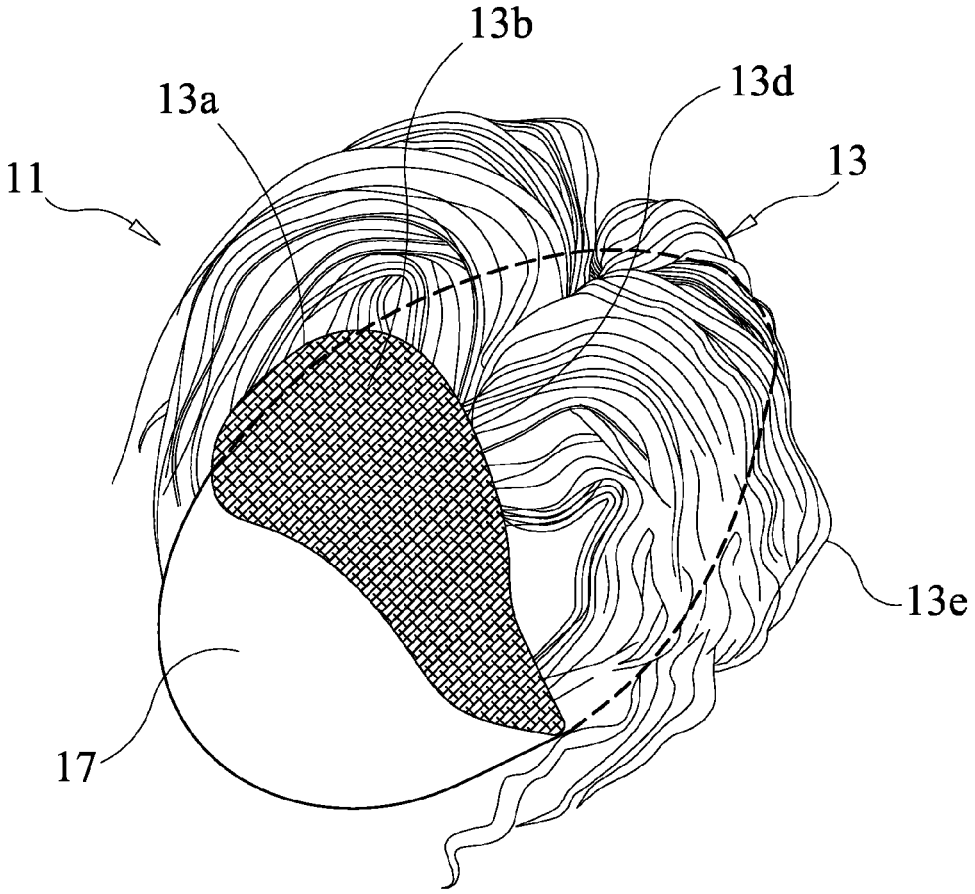
FIG. 1 is a schematic perspective view of the present invention hair system showing the hair unit and the silicone layer partly pulled up from each other, and partly pulled up from the dome shaped form.
Figure 2:
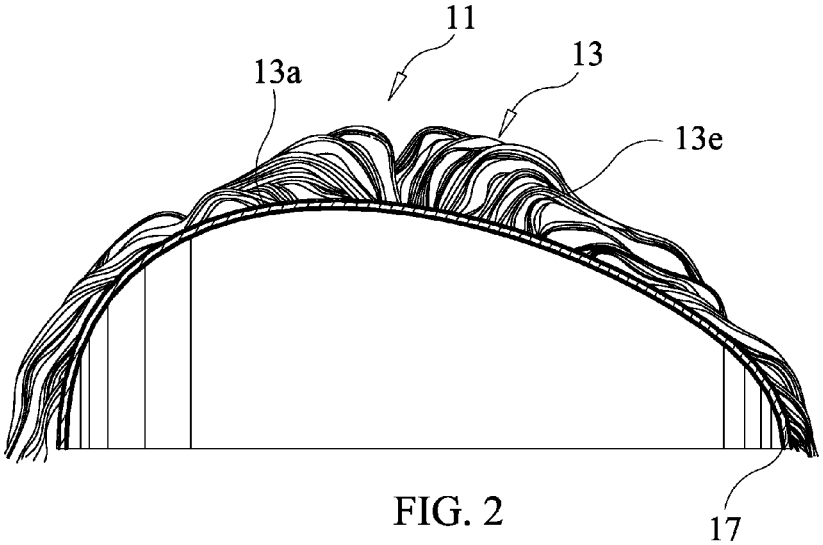
FIG. 2 is a schematic cross sectional view of an embodiment of the present invention hair system.
Figure 3:
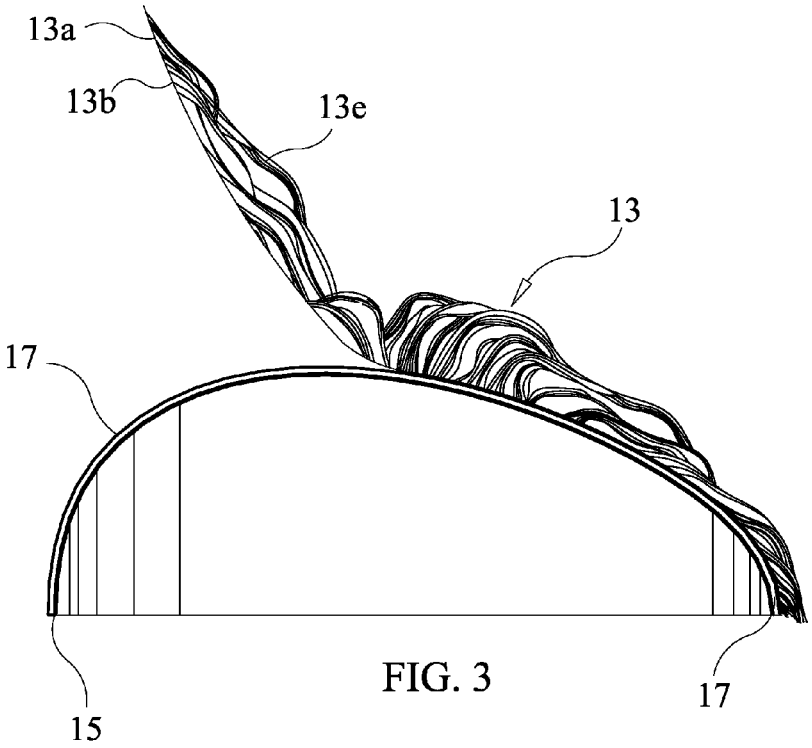
FIG. 3 is a schematic cross sectional view of the present invention hair system showing the hair unit partly pulled up, and the silicone layer remaining fixed to the dome shaped form.
Figure 4:
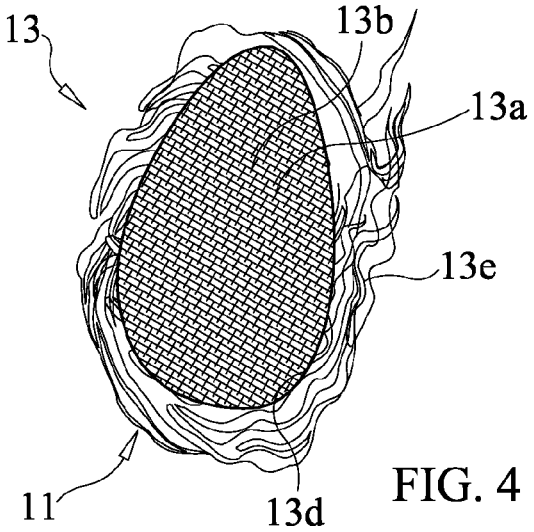
FIG. 4 is a top view of a hair unit of an embodiment of the present invention hair system turned inside out.
Figure 5:
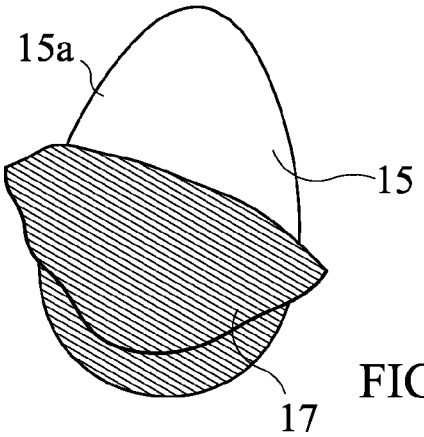
FIG. 5 is a top view showing the silicone layer partly pulled up from the dome shaped form of the present invention hair system.
Figure 6:
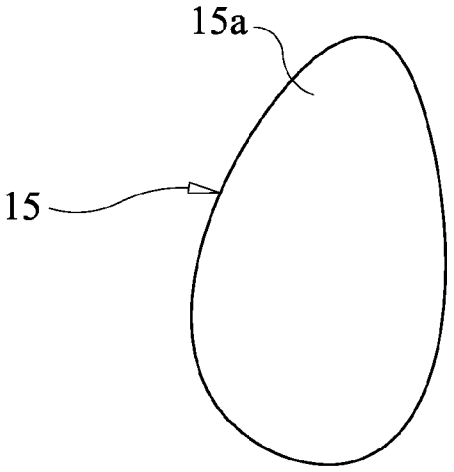
FIG. 6 is a top view showing the dome shaped form of the present invention hair system.

Referring now to the Figures in general, and specifically to FIG. 1-FIG. 6, embodiments of the present invention are directed to custom fitted hair systems that facilitate self application, and related methods of making and using such hair systems. A hair system 11 includes a thin skin type hair unit 13 having adhesive pre-applied to the inside surface 13*b*, a layer 17 of silicone is located on a dome shaped form 15, and the hair unit 13 is located on the form 15 and silicone layer 17 for ease of handling, storage, shipping, and use by the client.

The hair unit 13 of the hair system 11 includes a thin base sheet portion 13*a* having an inside surface 13*b* and an outside surface connected at a periphery 13*d*. A plurality of hair 13*e* extends outwardly from the outside surface, and one or more layers of liquid adhesive are pre applied to the inside surface 13*b* and allowed to dry to tack.

The hair system 11 further includes a dome shaped form 15 that has a generally convex 15*a* surface and a generally concave surface. The dome shaped form 15 is for receiving and supporting the hair unit 13. The "dome" shape roughly approximates the top of a human head. Preferably, the form 15 is rigid enough to maintain its shape to support the hair unit 13. The form 15 is a shell ranging from 0.1 mm-0.75 mm thick, made of a material (typically pvc, acrylate, or other polymer) that maintains the desired size and rigidity. Alternate shapes may be utilized for the form 15 that are sufficient to support the hair unit 13.

A sheet or layer 17 of silicone or other adhesion resistant material is located between the dome shaped form 15 and the inside surface 13*b* of the hair unit 13. The sheet or layer 17 has a first side in contact with (or forming part of) the convex 15*a* surface of the dome shaped form 15, and the sheet 17 and also has a second side in contact with the inside surface 13*b* of the hair unit 13. Alternately, the form 15 may be made of an adhesion resistant material, or have an outer layer 17 comprising an adhesion resistant material. Further, "adhesion resistant" is understood to be resistant to complete adhesion by the adhesive applied to the inside surface 13*b* of the hair unit 13.

The liquid adhesive as discussed herein is understood to mean a water based or solvent based liquid bonding agent used to bond hair units to the scalp of a client. There are various compositions available and known in the art, but most fall into solvent based or water based adhesive category. Preferably silicone is used as the adhesion resistant material, but alternate materials may be used, so long as said material inhibits the sticking of the hair unit 13 to the form 15. Preferably, the compound selected to form 15 the layer 17 is optimized such that the hair unit 13 (having the adhesive applied) can fit onto the form 15 without readily slipping off, yet also enable the hair unit 13 to be peeled from the form 15 and/or the layer 17.

The invention further includes a method of making a hair replacement system 11. The method includes the steps of providing a hair unit 13, and further providing a dome shaped form 15 that has an outer layer 17 of material that is resistant to sticking. The hair unit 13 includes a thin base sheet portion 13*a* having an inside surface 13*b* and an outside surface 13*c* connected at a periphery 13*d*, and a plurality of hair 13*e* extends outwardly from the outside surface 13*c*.

One or more layers of adhesive are applied to the inside surface 13*b* of the hair unit 13, and the adhesive is allowed to dry. The preferred mode of applying the adhesive is to brush it on. However, other methods may be employed such as spray, fog or misting may also be done sufficient to deposit adhesive onto the inside surface 13*b*. Multiple sub-steps of applying adhesive and drying—layer by layer—is preferred.

A dome shaped form 15 is provided. The dome shaped form 15 is as discussed herein, and has an outer layer 17 of material that is resistant to sticking by the adhesive applied to the inside surface 13*b* of the hair unit 13. The hair unit 13 is placed onto the dome shaped form 15 having the layer 17 of material that is resistant to sticking.

In a preferred embodiment of the present invention method, the outer layer 17 of material of the form 15 is made by the step of pouring a liquid silicone, or a liquid containing silicone, onto the outside (convex 15*a*) surface of the form 15. The liquid is allowed to cure to create the layer 17 on the form 15, and any excess that overlaps over the form 15 is cut off at the periphery 13*d*.

In an alternate embodiment of the present invention method, the outer layer 17 of material of the form 15 is made by (a) providing a material that is resistant to sticking by the adhesive applied to the inside surface 13*b* of the hair unit, and (b) locating the material over the dome shaped form 15. For example, an adhesive inert material may be placed or stretched over the form 15.

The invention further includes a method of making and using a hair replacement system 11, which is accomplished by performing the following steps. At a specification location, specifications are received or obtained from a client. The specifications include information relating to a size and shape of the area of the scalp that is desired to be covered with a hair unit 13, hair color, and hair style.

At a fabrication location, a hair unit 13 is fabricated to meet one or more of the specifications from the "obtaining specifications" step. The hair unit 13 is as described elsewhere herein and known in the art, and typically includes a thin base sheet portion 13*a* having an inside surface 13*b* and an outside surface connected at a periphery 13*d*, and a plurality of hair 13*e* extending outwardly from the outside surface.

One or more layers of adhesive are applied to the inside surface 13*b* of the hair unit, and the adhesive is allowed to dry to an extent. Preferably, incomplete curing to a "tack" is desired such that the adhesive is capable of being reactivated so the hair unit 13 can later be slidably applied to the scalp of a hair wearer client.

A dome shaped form 15 is provided. The dome shaped form 15 has an outer layer 17 of material that is resistant to sticking by the adhesive applied to the inside surface 13*b* of the hair unit 13 and allowed to dry to an extent discussed above. The hair unit 13 is placed onto the dome shaped form 15 having the stick resistant layer, such that the inside surface 13*b* of the hair unit 13 having the adhesive contacts the stick resistant layer 17. The layer 17 is located between the inside surface 13*b* of the hair unit 13 and the dome shaped form 15.

The hair unit, located on the dome shaped form 15, with the non stick layer 17 located between, is shipped to a client location. At the client location, the hair unit 13 is removed from the dome shaped form 15 and the layer 17 of material that is resistant to sticking. Removal is preferably accomplished with a peeling action—peeling the hair unit 13 from the dome and non stick layer 17.

A temporary adhesive reactivation solution is sprayed onto the inside surface 13*b* of the hair unit 13 and/or the scalp of the client. The reactivation solution, preferably is isopropyl alcohol, but other solutions effective to liquefy or activate the dried adhesive are also intended not to limit the invention. The combination of adhesive/reactivation solution ideally is matched to reactivate the adhesive and inhibit adhesion for a short period of time (10-60 seconds, for example) before the adhesive fixes to the scalp.

While the temporary adhesive reactivation solution remains effective to inhibit adhesion, the inside surface 13*b* of the hair unit 13 is placed onto the scalp of the client, and the inside surface 13*b* of the hair unit 13 is slid about the scalp to desirably locate the hair unit 13 on the scalp of the client. Although, self application of the hair unit 13 is the intended use, an assistant or hair technician may assist using the inventive system 11 and method.

In a preferred embodiment, the nonstick or stick resistant or adhesive resistant layer 17 discussed herein is accomplished by pouring a liquid containing silicone onto the convex 15*a* surface of the form 15. The liquid is allowed to cure to create the layer 17 on the form 15, and any excess that overlaps over the form 15 is cut off at the periphery 13*d*. Alternate compounds may be used, so long as said compound inhibits the sticking of the hair unit 13 to the form 15. Preferably, the compound selected to form 15 the layer 17 is optimized such that the hair unit 13 (having the adhesive applied) can securely fit onto the form 15 without readily slipping off, yet also enable the hair unit 13 to be peeled from the form 15 and/or layer 17. Alternate embodiments include a spray on liquid or aerosol that creates the nonstick or stick resistant or adhesive resistant layer 17 or film.

Another embodiment includes providing a material that is resistant to sticking by the adhesive applied to the inside surface 13*b* of the hair unit and locating the material over the dome shaped form 15. A solid adhesive resistant sheet material 17 may be stretched over the convex 15*a* surface of the form 15. Yet another embodiment concerns having the nonstick or stick resistant or adhesive resistant layer 17 formed 15 directly into the convex 15*a* surface of the form 15.

Regarding location, in a preferred embodiment of the present invention method, the specification location is the home location of a hear wearer client. For example, the client can obtain the specifications using instructions provided by the manufacturer. Alternately, the specification location is at a location of a hair technician, or stylist, or an assistant who aids the client in the obtaining specifications step. The obtaining specifications step may occur by phone, by mail, or online by transmitting specification information to or from the specification location.

The fabrication location, preferably is the location where the hair unit 13 is made using the specifications received from the obtaining specifications step. Preferably, the steps of (a) applying one or more layers of adhesive to the hair unit 13 (*b*) placing the hair unit 13 onto the dome shaped form 15, occur at the fabrication location. However, this disclosure is not intended to limit alternate locations wherein the above steps may occur, for reasons of cost, efficiency, expediency, or the like. Hair units without adhesive can be shipped to another location wherein one or more of steps (a) and (b) above may occur.

The client location, preferably refers to the location of the client. The client's home, or a location set by the client, at the client's discretion, such as at a hair technician's location, or at a salon.

The invention further includes a method of applying a hair replacement system, which comprises the following steps. A user is provided a hair system 11. The hair system 11 includes a hair unit 13 that includes a thin base sheet portion 13*a* having an inside surface 13*b* and an outside surface connected at a periphery 13*d*. A plurality of hair 13*e* extends outwardly from the outside surface, and one or more layers of liquid adhesive are applied to the inside surface 13*b* and allowed to dry to tack. The hair unit 13 is located on a dome shaped form 15 having a generally convex 15*a* surface and a generally concave surface. The form 15 has a layer 17 of silicone or other adhesion resistant material located between the dome shaped form 15 and the inside surface 13*b* of the hair unit 13. The silicone or adhesion resistant material has a first side in contact with (or forming part of) the convex 15*a* surface of the dome shaped form 15, and also has a second side in contact with the inside surface 13*b* of the hair unit 13. The hair unit 13 is removed (or peeled) from the dome shaped form 15, and a temporary adhesive reactivation solution is sprayed onto the inside surface 13*b* of the hair unit 13 and/or the scalp of the client. The inside surface 13*b* of the hair unit 13 is placed onto the scalp of the client, and is slidably moved about the scalp to desirably locate the hair unit 13 on the scalp, while the temporary adhesive reactivation solution remains effective to inhibit adhesion.

Although particular embodiments of the invention have been described in detail herein with reference to the accompanying drawings, it is to be understood that the invention is not limited to those particular embodiments, and that various changes and modifications, including the omission of steps or the interchangeability of the order of steps, may be effected therein by one skilled in the art without departing from the scope or spirit of the invention.

The invention claimed is:

1. A method of making and using a hair replacement system comprises:

at a specification location, obtaining specifications from a client relating to a size and shape of the area of the scalp that is desired to be covered with a hairpiece, hair color, and hair style;

at a fabrication location, fabricating a hair unit utilizing one or more of the specifications from the "obtaining specifications" step, the hair unit including a thin base sheet portion having an inside surface and an outside surface connected at a periphery, and a plurality of hair extending outwardly from the outside surface;

applying one or more layers of adhesive to the inside surface of the hair unit and allowing the one or more layers of adhesive to dry partly to tack;

providing a dome shaped form having an outer layer of material that is resistant to sticking by the adhesive applied to the inside surface of the hair unit;

placing the hair unit onto the dome shaped form having a layer of material that is resistant to sticking such that the inside surface of the hair unit having the adhesive contacts the layer of material that is resistant to sticking, said layer located between the inside surface of the hair unit and the dome shaped form;

at a client location, receiving the hair unit located on the dome shaped form having the layer of material that is resistant to sticking located between the hair unit and the dome shaped form;

at a client location, removing the hair unit from the dome shaped form and the layer of material that is resistant to sticking, spraying a temporary adhesion inhibitor solution onto the inside surface of the hair unit and/or the scalp of the client and, while the temporary adhesion inhibitor solution remains effective to inhibit adhesion, placing the inside surface of the hair unit onto the scalp of the client, and slidably moving the inside surface of the hair unit about the scalp to desirably locate the hair unit on the scalp of the client.

2. The method of claim 1, the step of "providing a dome shaped form" includes pouring a liquid containing silicone onto the form.

3. The method of claim 1, the step of "providing a dome shaped form" includes providing a material that is resistant to sticking by the adhesive applied to the inside surface of the hair unit, and locating the material over the dome shaped form.

4. The method of claim 1, the step of "providing a dome shaped form" includes pouring a liquid containing silicone onto the form.

5. The method of claim 1, the step of "providing a dome shaped form" includes providing a dome shaped form that has a silicone outer surface layer added on to or formed into the dome shaped form.

6. The method of claim 1, the steps of "applying one or more layers of adhesive" and "placing the hair unit onto a dome shaped form" are performed at the fabrication location.

7. A method of application of a hair replacement system comprises:

obtaining a hair system having: (a) a hair unit that includes a thin base sheet portion having an inside surface and an outside surface connected at a periphery, a plurality of hair extending outwardly from the outside surface, and one or more layers of liquid adhesive applied to the inside surface and allowed to dry to tack, (b) the hair unit located on a dome shaped form having a generally convex surface, (c) the form has a layer of silicone or other adhesion resistant material located between the dome shaped form and the inside surface of the hair unit, the material having a first side in contact with or forming part of the convex surface of the dome shaped form, and also having a second side in contact with the inside surface of the hair unit;

removing the hair unit from the dome shaped form having the layer of silicone or other adhesive resistant material;

spraying a temporary adhesion inhibitor solution onto the inside surface of the hair unit and/or the scalp of the client;

placing the inside surface of the hair unit onto the scalp of the client; and slidably moving the inside surface of the hair unit about the scalp to desirably locate the hair unit on the scalp, while the temporary adhesion inhibitor solution remains effective to inhibit adhesion.

* * * * *